US008247043B2

(12) United States Patent
Tanaka et al.

(10) Patent No.: US 8,247,043 B2
(45) Date of Patent: Aug. 21, 2012

(54) RECORDING MEDIUM

(75) Inventors: Takatoshi Tanaka, Kawasaki (JP); Hiroshi Asakawa, Ebina (JP); Hitoshi Nagashima, Kawasaki (JP); Masaya Asao, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/112,175

(22) Filed: May 20, 2011

(65) Prior Publication Data

US 2011/0300316 A1 Dec. 8, 2011

(30) Foreign Application Priority Data

Jun. 4, 2010 (JP) ..... 2010-129272

(51) Int. Cl.
*B41M 5/00* (2006.01)

(52) U.S. Cl. ..... 428/32.18; 428/32.31

(58) Field of Classification Search ..... 428/32.18, 428/32.31

See application file for complete search history.

(56) References Cited

U.S. PATENT DOCUMENTS

| | | | | |
|---|---|---|---|---|
| 6,436,515 | B1 | 8/2002 | Ohbayashi et al. | |
| 6,613,419 | B2 | 9/2003 | Ohbayashi et al. | |
| 6,848,781 | B2 | 2/2005 | Ogino et al. | |
| 7,291,361 | B2 | 11/2007 | Ogino et al. | |
| 7,662,452 | B2 | 2/2010 | Nagashima et al. | |
| 7,846,516 | B2 | 12/2010 | Kamo et al. | |
| 7,867,586 | B2 | 1/2011 | Kamo et al. | |
| 2002/0025413 | A1 | 2/2002 | Ohbayashi et al. | |
| 2002/0196322 | A1 * | 12/2002 | Fujii et al. | 347/105 |
| 2003/0167950 | A1 * | 9/2003 | Mori | 101/453 |
| 2004/0131892 | A1 * | 7/2004 | Sueki et al. | 428/694 T |
| 2010/0098866 | A1 | 4/2010 | Nagashima et al. | |
| 2010/0183828 | A1 | 7/2010 | Asao et al. | |
| 2010/0310795 | A1 | 12/2010 | Tanaka et al. | |
| 2011/0059298 | A1 | 3/2011 | Nagashima et al. | |

FOREIGN PATENT DOCUMENTS

| | | | |
|---|---|---|---|
| JP | 2000-355160 | A | 12/2000 |
| JP | 2001-347748 | A | 12/2001 |

OTHER PUBLICATIONS

Aug. 5, 2011 European Search Report in European Patent Appln. No. 11004324.7.

Quick Guide to Precision Measuring Instruments, Surftest (Surface Roughness Testers), pp. 38-39 [retrieved on Mar. 8, 2012]. Retrieved from the Internet: <URL: http://www.mitutoyo.co.jp/eng/products/menu/QuickGuide_Surftest.pdf>.

Softgauge Basic Framework, Specification of Parameters, Chapter 3 [retrieved on Mar. 8, 2012]. Retrieved from the Internet: <URL: http://161.112.232.32/softgauges/pdf/Specification.pdf>.

U.S. Appl. No. 13/023,803, filed Feb. 9, 2011, Takatoshi Tanaka.

U.S. Appl. No. 13/110,521, filed May 18, 2011, Hiroshi Asakawa.

U.S. Appl. No. 13/111,213, filed May 19, 2011, Masaya Asao.

* cited by examiner

*Primary Examiner* — Betelhem Shewareged

(74) *Attorney, Agent, or Firm* — Fitzpatrick, Cella, Harper & Scinto

(57) ABSTRACT

The invention provides a recording medium capable of inhibiting occurrence of undertrapping, lowering the visibility of scratches on the outermost surface of the recording medium and inhibiting occurrence of a mottled pattern when recording is conducted. The recording medium has a substrate and an ink receiving layer provided on the substrate, wherein the arithmetic average roughness Ra of the outermost surface of the recording medium as prescribed by JIS B 0601:2001 is 1.1 μm or more and 2.5 μm or less, and the skewness Rsk of a roughness curve of the outermost surface of the recording medium as prescribed by JIS B 0601:2001 is 0.1 or less.

10 Claims, No Drawings

RECORDING MEDIUM

BACKGROUND OF THE INVENTION

1. Field of the Invention

The present invention relates to a recording medium.

2. Description of the Related Art

As a method for adjusting the surface glossiness of a recording medium having an ink receiving layer on a substrate, there is known a method of controlling the surface roughness of the recording medium. Japanese Patent Application Laid-Open No. 2000-355160 describes a recording medium with a center line average roughness (height) of the surface of 0.8 μm to 4.0 μm and a 60-degree specular glossiness of 10% to 30%. Japanese Patent Application Laid-Open No. 2001-347748 describes a recording medium with a center line average roughness of the surface of 0.4 μm to 2.5 μm and a 10-point average roughness that is 5 times to 20 times as much as the center line average roughness. These recording media are such that gloss unevenness and glaringness due to surface gloss in a recorded image are inhibited by controlling the surface roughness of the recording medium.

SUMMARY OF THE INVENTION

When an image is recorded on recording media and the recording media are then stored in such a manner that their recording surfaces come into contact with each other, such a phenomenon wherein it seems as if the form of one image whitely appears on another image (undertrapping) may occur in some cases. This is considered to be attributable to the fact that water or water-soluble organic solvents transfer between the contacted recording media. When water or water-soluble organic solvents transfer, a difference in amount of present water or water-soluble organic solvents arises between a portion where they have transferred and a portion where they have not transferred or negligibly transferred. This is considered to cause the undertrapping on the image.

There is another problem that scratches are caused on the outermost surfaces of recording media due to contact and rubbing between the recording media, and the scratches which can be sighted impair the appearances of the recording media.

The recording media described in Japanese Patent Application Laid-Open Nos. 2000-355160 and 2001-347748 have been eagerly investigated. As a result, when the surface roughness of a recording medium is small, adhesion between such recording media upon contact with each other is high, and so there is a tendency to cause undertrapping. In addition, the glossiness of the outermost surface of the recording medium is high, and there is a tendency for scratches to be clearly sighted.

On the other hand, when the surface roughness of the outermost surface of the recording medium is made great for the purpose of solving these problems, an ink may collect in dented portions of the uneven profile of the outermost surface of the recording medium to cause a mottled pattern according to the uneven profile in some cases. It has been difficult to inhibit this mottled pattern according to the uneven profile by only controlling the center line average roughness and 10-point average roughness of the recording medium.

Accordingly, it is an object of the present invention to provide a recording medium capable of inhibiting occurrence of undertrapping, lowering the visibility of scratches on the outermost surface of the recording medium and inhibiting occurrence of a mottled pattern when recording is conducted.

In order to achieve the above object, the present invention provides a recording medium comprising a substrate and an ink receiving layer provided on the substrate, wherein the arithmetic average roughness Ra of the outermost surface of the recording medium as prescribed by JIS B 0601:2001 is 1.1 μm or more and 2.5 μm or less, and the skewness Rsk of a roughness curve of the outermost surface of the recording medium as prescribed by JIS B 0601:2001 is 0.1 or less.

According to the present invention, there can be provided a recording medium capable of inhibiting occurrence of undertrapping, lowering the visibility of scratches on the outermost surface of the recording medium and inhibiting occurrence of a mottled pattern when recording is conducted.

Further features of the present invention will become apparent from the following description of exemplary embodiments.

DESCRIPTION OF THE EMBODIMENTS

Preferred embodiments of the present invention will now be described in detail. Incidentally, the present invention is not interpreted as being limited to these descriptions.

Recording Medium

The recording medium according to the present invention is a recording medium having a substrate and an ink receiving layer provided on the substrate. The recording medium according to the present invention can be used as, for example, a recording medium for conducting recording with a felt-tip pen or a recording medium for conducting recording by an ink jet recording method. The ink receiving layer may be provided on one surface or both surfaces of the substrate. In addition, one or more ink receiving layers may be provided on the substrate.

In the recording medium according to the present invention, the arithmetic average roughness Ra of the outermost surface of the recording medium as prescribed by JIS B 0601:2001 is 1.1 μm or more and 2.5 μm or less. When the Ra is 1.1 μm or more, a contact area between the mutual outermost surfaces of the recording media can be made small even when the outermost surfaces of the recording media come into contact with each other after recording of images thereon. The transfer of water or water-soluble organic solvents between the recording media is thus hard to occur, whereby the occurrence of undertrapping can be inhibited. The Ra is 1.1 μm or more, whereby it can be inhibited for the glossiness of the recording medium to become too high, and so the visibility of scratches on the outermost surface of the recording medium can be lowered. The Ra is favorably 1.3 μm or more from the viewpoints of more inhibiting the occurrence of undertrapping and more lowering the visibility of scratches on the outermost surface. On the other hand, if the Ra is larger than 2.5 μm, the volume of dented portions of the uneven profile becomes too large even if an Rsk value, which will be described subsequently, is changed, and so a mottled pattern according to the uneven profile may occur in some cases when an ink is applied to such a recording medium. When recording is conducted by ink jet recording in particular, there is a tendency to easily cause the mottled pattern because the ink is applied at a high speed. Thus, the Ra is 2.5 μm or less. The Ra of the outermost surface of the recording medium is favorably 2.0 μm or less. In short, in the present invention, the arithmetic average roughness Ra of the outermost surface of the recording medium as prescribed by JIS B 0601:2001 is favorably 1.3 μm or more and 2.0 μm or less. Incidentally, the outermost surface of the recording medium in the present invention means a surface, of the surfaces of the recording medium, on which an ink is applied to conduct recording. In the case of, for example, a recording medium having one ink receiving layer as an outermost layer on one surface of a substrate, the surface of the ink receiving layer on the opposite side to the substrate side is an outermost surface of the recording medium. In the case of a recording medium having an ink receiving layer as an outermost layer on each surface of a substrate, the surface of each ink receiving layer on the opposite side to the substrate side is an outermost surface of the recording medium.

In addition, in the recording medium according to the present invention, the skewness Rsk of a roughness curve of the outermost surface of the recording medium as prescribed by JIS B 0601:2001 is 0.1 or less. The Ra is 1.1 μm or more and 2.5 μm or less and the Rsk is 0.1 or less, whereby the volume of dented portions of the uneven profile can be made sufficiently small. As a result, it can be inhibited to cause the mottled pattern according to the uneven profile when an ink is applied to the recording medium. The Rsk expresses a characteristic in a height direction of surface roughness. When a dented portion is larger than a protruded portion, the Rsk indicates a positive value, while the Rsk indicates a negative value when the dented portion is smaller than the protruded portion. When the Rsk is larger than 0.1, the volume of the dented portions is comparatively large even when the Ra is within a range of 1.1 μm or more and 2.5 μm or less, and so the mottled pattern according to the uneven profile is liable to occur. In order to make the volume of the dented portions small to inhibit the occurrence of the mottled pattern, the Rsk is favorably 0.0 or less. The Rsk is favorably −1.5 or more from the viewpoint of easiness of the formation of the uneven profile.

The average length RSm of a roughness curve element of the outermost surface of the recording medium as prescribed by JIS B 0601:2001 is favorably 0.65 mm or less from the viewpoint of making the volume of the dented portions smaller. The RSm expresses a characteristic in a lateral direction (horizontal direction) of surface roughness and a value indicating a space between dented and protruded portions. The RSm is controlled to 0.65 mm or less, whereby the volume of the dented portions can be made smaller though it depends on the characteristic in the vertical direction (height direction). As a result, the occurrence of the mottled pattern according to the uneven profile can be more satisfactorily inhibited. The RSm is more favorably 0.60 mm or less from the viewpoint of making the volume of the dented portions still smaller. The RSm is favorably 0.10 mm or more.

As a method for controlling the Ra, Rsk and RSm of the outermost surface of the recording medium within the above respective ranges, the following methods are mentioned. For example, when an ink receiving layer is provided as an outermost layer of the recording medium, there is a method of adding inorganic or organic particles having an average particle size of 1 μm to 20 μm to the ink receiving layer. In addition, there are a method of engraving fine unevenness and a method of providing an ink receiving layer on the uneven substrate. In the method of providing an ink receiving layer on the uneven substrate, the surface of the substrate is subjected to an unevenness-embossing treatment. An ink receiving layer coating liquid is then applied on to this substrate to form an ink receiving layer, whereby unevenness of the same profile as the unevenness of the substrate can be formed on the surface of the ink receiving layer, i.e., an outermost layer of the recording medium. When the ink receiving layer is formed of a hard porous film in particular, this method is suitable. In this case, a substrate favorably used is a resin-coated substrate obtained by coating a base material with a resin. A resin-coated substrate obtained by coating both surfaces of a paper base material with a polyolefin resin is particularly favorable. As a method for embossing unevenness on the polyolefin resin surface, there is a method of coating a base material by extruding a molten polyolefin resin and then bring the coated surface into contact under pressure with an embossing roller to apply a pattern of fine unevenness to the surface of the polyolefin resin. There are, for example, the following two methods as methods for conducting patterning. One method is a method of subjecting resin-coated paper obtained by melt extrusion to an embossing calender treatment at a temperature near to room temperature. The other method is a method of forming unevenness while cooling by means of a cooling roll with the surface of the roll engraved with a pattern upon extrusion coating of the polyolefin resin. In particular, the latter method is favorable because the embossing can be conducted under a relatively low pressure, and more exact and even embossing can be conducted.

When the ink receiving layer is a porous ink receiving layer, the coating thickness of the ink receiving layer is liable to be great. Therefore, the uneven profile of the surface of the substrate is hard to appear on the surface of the ink receiving layer. Thus, in the case of a recording medium obtained by coating a substrate on the surface of which an uneven profile has been provided in advance with an ink receiving layer coating liquid, the surface roughness of the substrate is favorably made greater than the surface roughness of the surface of the ink receiving layer. Specifically, the arithmetic average roughness Ra of the surface of the substrate as prescribed by JIS B 0601:2001 is favorably 1.5 μm or more, more favorably 1.6 μm or more. The arithmetic average roughness Ra of the surface of the substrate is favorably 6.0 μm or less, more favorably 3.0 μm or less.

The coating thickness of the ink receiving layer is favorably 30 μm or more and 45 μm or less from the viewpoints of ink absorbency and inhibition of cracking. When the coating thickness of the ink receiving layer is 30 μm or more, the occurrence of cracking can be inhibited. Incidentally, the coating thickness in the present invention is a thickness measured upon absolute drying. In the present invention, the recording medium is formed into a square, the thickness upon absolute drying of a portion 1 cm away toward the direction of the center of gravity of the quadrangle from each corner is measured by means of a scanning electron microscope, and the average value of the measured values is regarded as the coating thickness.

The surface pH of paper in the recording medium as prescribed by TAPPI T 529 om-04 is favorably 4.3 or more. The surface pH of paper is controlled to 4.3 or more, whereby the occurrence of bronzing can be inhibited and the lowering of ink absorbency due to the occurrence of bronzing can also be inhibited.

Materials used in the recording medium according to the present invention will hereinafter be described in detail.

Substrate

As the substrate of the present invention, may be favorably used paper such as cast-coated paper, baryta paper or resin-coated paper (resin-coated paper with a base material coated with a resin such as polyolefin). In addition, a transparent thermoplastic film formed of polyethylene, polypropylene, polyester, polylactic acid, polystyrene, polyacetate, polyvinyl chloride, cellulose acetate, polyethylene terephthalate, polymethyl methacrylate or polycarbonate may be favorably used. Besides the above, waterleaf paper or coat paper that is moderately sized paper, or a sheet-like material (synthetic paper or the like) formed of a film opacified by filling an inorganic material or by fine foaming may also be used. In addition, a sheet formed of glass or metal may also be used.

Further, the surfaces of these substrates may also be subjected to a corona discharge treatment or various undercoating treatments for the purpose of improving adhesion strength between such a substrate and the layer formed thereon. Among the above-described substrates, the resin-coated paper is favorably used from the viewpoint of a glossy feeling of the resulting recording medium.

Ink Receiving Layer

The ink receiving layer of the present invention favorably contains a pigment and a binder. The ink receiving layer may additionally contain a crosslinking agent, a pH adjustor and various additives. These components will now be described in detail.

As an inorganic pigment, is favorably a white pigment such as precipitated calcium carbonate, magnesium carbonate, kaolin, barium sulfate, aluminum silicate, magnesium silicate, synthetic amorphous silica, colloidal silica, wet or dry silica sol, or alumina hydrate. These inorganic pigments may be used either singly or in any combination thereof.

Among these, silica or alumina hydrate is favorable from the viewpoint of ink absorbency. Alumina hydrate is more favorable from the viewpoint of inhibiting the occurrence of undertrapping. On the other hand, gas phase process silica is favorable from the viewpoint of lowering of the visibility of scratches on the outermost surface of the resulting recording medium.

Favorable examples of the binder used include polyvinyl alcohol (PVA), oxidized starch, etherified starch, phosphoric acid esterified starch, carboxymethyl cellulose, hydroxyethyl cellulose, casein, gelatin, soybean protein, polyvinyl pyrrolidone, maleic anhydride resins, latexes of conjugated polymers such as styrene-butadiene copolymers and methyl methacrylate-butadiene copolymers, latexes of acrylic polymers such as acrylic ester and methacrylic ester polymers, latexes of vinyl polymers such as ethylene-vinyl acetate copolymers, melamine resins, urea resins, polymer or copolymer resins of acrylic esters and methacrylic esters, such as polymethyl methacrylate, polyurethane resins, unsaturated polyester resins, vinyl chloride-vinyl acetate copolymers, polyvinyl butyral, and alkyd resins. The above-described binders may be used either singly or in any combination thereof. Among these, PVA is the most favorably used binder. Examples of the PVA include PVA obtained by hydrolyzing polyvinyl acetate. PVA having a viscosity-average polymerization degree of 1,500 or more and 5,000 or less is favorable. The saponification degree thereof is favorably 70 or more and 100 or less. Besides the above, modified PVA such as PVA cationically modified at the terminal thereof or anionically modified PVA having an anionic group may also be used. The content ratio of the pigment to the binder in the ink receiving layer is favorably 1:1 to 13:1 by mass.

No particular limitation is imposed on the crosslinking agent so far as the effect of the present invention is not impaired. However, when PVA is used as a binder, the crosslinking agent is favorably that capable of causing a crosslinking reaction with PVA to cause curing. In particular, boric acid is favorable as the crosslinking agent. Examples of usable boric acid include metaboric acid and hypoboric acid in addition to orthoboric acid ($H_3BO_3$). However, orthoboric acid is favorably used from the viewpoints of the long-term stability of the resulting coating liquid and an effect to inhibit the occurrence of cracking.

The amount of the boric acid used is favorably within a range of 0.2 equivalents or more and 1.2 equivalents or less based on the PVA in the ink receiving layer. With respect to the term "equivalent", the amount of a crosslinking agent theoretically completely reacting with the hydroxyl group of the PVA is regarded as 1.0 equivalent. The amount of a crosslinking agent is controlled within the above range, whereby the long-term stability of the ink receiving layer coating liquid can be particularly improved. In general, the coating liquid comes to be used over a long period of time upon the formation of the ink receiving layer. The content of the boric acid in the coating liquid is controlled within the above range, whereby viscosity increase of the coating liquid and occurrence of gelled products, which are caused during use of the coating liquid for a long period of time, can be excellently prevented. Therefore, replacement of the coating liquid or cleaning of a coater head may not be frequently conducted, so that lowering of productivity of the recording medium can be inhibited. In addition, when the content of the boric acid in the coating liquid falls within the above range, a uniform and good surface can be obtained.

When an ink receiving layer formed by coating a substrate with an ink receiving layer coating liquid is used as the ink receiving layer, any one of the following acids may be suitably added as a pH adjustor into the ink receiving layer coating liquid. Examples of the acids include formic acid, acetic acid, glycolic acid, oxalic acid, propionic acid, malonic acid, succinic acid, adipic acid, maleic acid, malic acid, tartaric acid, citric acid, benzoic acid, phthalic acid, isophthalic acid, terephthalic acid, glutaric acid, gluconic acid, lactic acid, asparagic acid, glutamic acid, pimelic acid, suberic acid, methanesulfonic acid, and inorganic acids such as hydrochloric acid, nitric acid and phosphoric acid. For example, when alumina hydrate is used as the inorganic pigment, a monobasic acid is favorably used for dispersing the alumina hydrate in water. Therefore, among the above-described pH adjustors, an organic acid such as formic acid, acetic acid, glycolic acid or methanesulfonic acid, or an inorganic acid such as hydrochloric acid or nitric acid is favorably used. As additives, a pigment dispersant and a fastness improver may be suitably added within limits not greatly changing a contact angle of the surface of the ink receiving layer with respect to ion-exchanged water after the formation of the ink receiving layer.

Production Process of Recording Medium

The recording medium according to the present invention is produced according to the following process. First, an ink receiving layer coating liquid, which is obtained by mixing an inorganic pigment, binder, crosslinking agent, pH adjustor, various additives and water, is prepared. The ink receiving layer coating liquid is applied to a substrate and dried to form an ink receiving layer, whereby a recording medium according to the present invention can be produced. Incidentally, the kinds and amounts of these materials used in the ink receiving layer may be suitably chosen for use so as to satisfy the requirements of the present invention.

The coating method of the ink receiving layer coating liquid will now be described. The coating of the ink receiving layer coating liquid is conducted by on-machine or off-machine coating using any one of, for example, various kinds of curtain coaters, a coater using an extrusion system and a coater using a slide hopper system so as to give a proper coating amount. Upon the coating, the coating liquid may be heated or a coater head may be heated for the purpose of adjusting the viscosity of the coating liquid. For example, a hot air dryer such as a linear tunnel dryer, arch dryer, air loop dryer or sine curve air float dryer may be used for drying of the coating liquid after coating. An infrared heating dryer or a dryer utilizing microwaves may also be used.

The present invention will hereinafter be described in detail by the following Examples and Comparative Examples. However, the contents of the present invention are not limited to these examples. Incidentally, "parts" or "part" and "%" are based on the mass unless expressly noted.

Measuring Method of Surface Roughness

Measurements of arithmetic average roughness Ra, skewness Rsk of a roughness curve and average length RSm of a roughness curve element were conducted under the following measuring conditions by means of the following measuring apparatus.

Measuring apparatus: Surfcorder SE3500 (manufactured by Kosaka Laboratory, Ltd.)

Measuring conditions: The measurement was conducted by setting a cutoff value according to JIS B 0601:2001 and conducting evaluation with the length 5 times as much as the cutoff value as an evaluation length.

Preparation of Substrate

Twenty parts of precipitated calcium carbonate was added into a slurry of 100 part of Laubholz bleached kraft pulp, 2.0 parts of cationized starch and 0.3 parts of an alkenylsuccinic anhydride neutral sizing agent were added, and these components were sufficiently mixed to prepare a paper stock. This paper stock was dried to a water content of 10% by means of a Fourdrinier multi-cylinder paper machine, and a 7% solution of oxidized starch was applied to both sides of the dried product by a size press so as to give a coating amount of 4 g/m$^2$ in total. The thus-coated product was further dried to a water content of 7% to prepare base paper having a basis weight of 110 g/m$^2$. A resin composition composed of 70 parts of low density polyethylene and 20 parts of high density polyethylene was applied by melt extrusion to both sides of the base paper in an amount of 30 g/m$^2$ on one side. Just after the application, the polyethylene surfaces were subjected to ten embossing treatments using cooling rolls having unevennesses of irregular profiles different from one another on their surfaces while cooling. Differences among the embossing treatments were created by adjusting the width and the height between dented and protruded portions in the cooling roll. In this manner, substrates A to K each having a basis weight of 170 g/m$^2$ were prepared. The Ra, Rsk and RSm of each substrate are shown in Table 1. Incidentally, both surfaces of the substrate had the values shown in Table 1.

TABLE 1

| | Ra (μm) | Rsk | RSm (mm) |
|---|---|---|---|
| Substrate A | 2.0 | −0.2 | 0.5 |
| Substrate B | 2.0 | −0.2 | 0.65 |
| Substrate C | 2.0 | −0.2 | 0.7 |
| Substrate D | 1.5 | −0.2 | 0.5 |
| Substrate E | 3.0 | −0.2 | 0.5 |
| Substrate F | 2.0 | 0.1 | 0.5 |
| Substrate G | 3.0 | 0.1 | 0.7 |
| Substrate H | 1.3 | −0.2 | 0.5 |
| Substrate I | 3.2 | −0.2 | 0.5 |
| Substrate J | 2.0 | 0.2 | 0.5 |
| Substrate K | 2.3 | −0.2 | 0.5 |

Preparation of Ink Receiving Layer Coating Liquid A

Alumina hydrate (trade name: Disperal HP14, product of Sasol Co.) was added into ion-exchanged water so as to give a concentration of 30%. Methanesulfonic acid was then added in an amount of 1.5% based on this alumina hydrate, and the resultant mixture was stirred to obtain a colloidal sol. The resultant colloidal sol was diluted with ion-exchanged water in such a manner that the proportion of the alumina hydrate is 27%, thereby obtaining colloidal sol A.

On the other hand, polyvinyl alcohol (trade name: PVA 235, product of Kuraray Co., Ltd.; polymerization degree: 3,500, saponification degree: 88%) was dissolved in ion-exchange water to obtain a 8.0% aqueous solution of polyvinyl alcohol. The resultant polyvinyl alcohol solution was mixed with colloidal sol A in such a manner that the proportion of polyvinyl alcohol is 10.0% based on the alumina hydrate. A 3.0% aqueous solution of boric acid was then mixed with the resultant mixture in such a manner that the proportion of boric acid is 2.0% based on the alumina hydrate, thereby preparing an ink receiving layer coating Liquid A.

Preparation of Ink Receiving Layer Coating Liquid B

One hundred parts of silica (trade name: A300, product of Nippon Aerosil Co., Ltd.) and 4 parts of a cationic polymer (trade name: SHALLOL DC902P, product of DAI-ICHI KOGYO SEIYAKU CO., LTD.) were dispersed in ion-exchanged water so as to give a solid content concentration of 18%, and the resultant mixture was dispersed by a high-pressure homogenizer to obtain colloidal sol B.

On the other hand, polyvinyl alcohol (trade name: PVA 235, product of Kuraray Co., Ltd.; polymerization degree: 3,500, saponification degree: 88%) was dissolved in ion-exchange water to obtain a 8.0% aqueous solution of polyvinyl alcohol. The resultant polyvinyl alcohol solution was mixed with colloidal sol B in such a manner that the proportion of polyvinyl alcohol is 20.0% based on the silica. A 3.0% aqueous solution of boric acid was then mixed with the resultant mixture in such a manner that the proportion of boric acid is 3.5% based on the silica, thereby preparing an ink receiving layer coating Liquid B.

EXAMPLE 1

The ink receiving layer coating liquid A was applied on to the substrate A and dried at 60° C. to prepare a recording medium 1 having an ink receiving layer having a coating thickness of 32 μm.

EXAMPLE 2

The ink receiving layer coating liquid A was applied on to a surface opposite to the surface of the substrate of the recording medium 1 on which the ink receiving layer has been provide and dried at 60° C. to prepare a recording medium 2 having ink receiving layers each having a coating thickness of 32 μm on both sides thereof.

EXAMPLE 3

A recording medium 3 was prepared in the same manner as in Example 1 except that the ink receiving layer coating liquid A in Example 1 was changed to the ink receiving layer coating liquid B.

EXAMPLE 4

A recording medium 4 was prepared in the same manner as in Example 1 except that the substrate A in Example 1 was changed to the substrate B.

EXAMPLE 5

A recording medium 5 was prepared in the same manner as in Example 1 except that the substrate A in Example 1 was changed to the substrate C.

EXAMPLE 6

A recording medium 6 was prepared in the same manner as in Example 1 except that the substrate A in Example 1 was changed to the substrate D.

EXAMPLE 7

A recording medium 7 was prepared in the same manner as in Example 3 except that the substrate A in Example 3 was changed to the substrate D.

EXAMPLE 8

The ink receiving layer coating liquid B was applied on to a surface opposite to the surface of the substrate of the recording medium 7 on which the ink receiving layer has been provide and dried at 60° C. to prepare a recording medium 8 having ink receiving layers each having a coating thickness of 32 μm on both sides thereof.

EXAMPLE 9

A recording medium 9 was prepared in the same manner as in Example 1 except that the substrate A in Example 1 was changed to the substrate E.

EXAMPLE 10

A recording medium 10 was prepared in the same manner as in Example 1 except that the substrate A in Example 1 was changed to the substrate F.

EXAMPLE 11

A recording medium 11 was prepared in the same manner as in Example 1 except that the substrate A in Example 1 was changed to the substrate G.

EXAMPLE 12

A recording medium 12 was prepared in the same manner as in Example 1 except that the substrate A in Example 1 was changed to the substrate K.

COMPARATIVE EXAMPLE 1

A recording medium 13 was prepared in the same manner as in Example 1 except that the substrate A in Example 1 was changed to the substrate H.

COMPARATIVE EXAMPLE 2

A recording medium 14 was prepared in the same manner as in Example 3 except that the substrate A in Example 3 was changed to the substrate H.

COMPARATIVE EXAMPLE 3

A recording medium 15 was prepared in the same manner as in Example 1 except that the substrate A in Example 1 was changed to the substrate I.

COMPARATIVE EXAMPLE 4

A recording medium 16 was prepared in the same manner as in Example 1 except that the substrate A in Example 1 was changed to the substrate J.

COMPARATIVE EXAMPLE 5

A recording medium 17 was prepared in the same manner as in Example 3 except that the substrate A in Example 3 was changed to the substrate J.

The Ra, Rsk and RSm of the outermost surface of each recording medium are as shown in Table 2. Each of the recording media was subjected to the following evaluations, and the evaluated results thereof are shown collectively in Table 2.

Evaluations

Undertrapping

Two recording media of the same kind were first provided. The following image 1 was then recorded on the ink receiving layer of one recording medium with a gloss Pro-Platinum grade mode (criteria setting, color/density: non-matched) by means of an ink jet recording apparatus (trade name: PIXUS MP990, manufactured by Canon Inc.). Likewise, the following image 2 was recorded on the ink receiving layer of the other recording medium.

Image 1: Image solid-printed on a region of 15 cm by 15 cm at (R,G,B)=(0,0,0) by the RGB mode of PhotoShop 7.0.

Image 2: Image solid-printed on a region of 5 cm by 5 cm at (R,G,B)=(255,255,0) by the RGB mode of PhotoShop 7.0.

After the recording of the images, the recording media were dried for 30 minutes under an environment of 23° C. and 50% RH, and the recording media were put together in such a manner that the image 1 and the image 2 come into contact with each other, and stored for 24 hours. After the storage for 24 hours, a portion where the image 1 and the image 2 are in contact with each other was compared with a portion where they are not in contact with each other to visually evaluate the recording media as to the occurrence of undertrapping according to the following criteria. Incidentally, in the recording media with the ink receiving layers formed on both sides of the substrate, like those of Examples 2 and 8, the image 1 was recorded on the formerly formed ink receiving layer of one recording medium, and the image 2 was recorded on the subsequently formed ink receiving layer of the other recording medium, thereby making the evaluation.

A: No undertrapping was observed

B: Undertrapping was slightly observed

C: Undertrapping was clearly observed

Scratch

The image 1 was recorded on two recording media of the same kind under the same conditions as in the evaluation of undertrapping. After the recording of the image, the recording media were dried for 24 hours under an environment of 23° C. and 50% RH, the recording media were then put together in such a manner that the images 1 come into contact with each other, and a weight of 1.5 g/m$^2$ was placed thereon to conduct the operation of rubbing both recording media together by a stroke of about 3 cm repeatedly 50 times. Thereafter, scratches on the images 1 were visually evaluated according to the following criteria. Incidentally, in the recording media with the ink receiving layers formed on both sides of the substrate, like those of Examples 2 and 8, the image 1 was recorded on the formerly formed ink receiving layer of one recording medium, and the image 1 was recorded on the subsequently formed ink receiving layer of the other recording medium, thereby making the evaluation.

A: No scratch was observed

B: Scratches were slightly observed

C: Scratches were clearly observed

Mottled Pattern According to Uneven Profile

One recording medium was provided, and the following image 3 was recorded thereon under the same conditions as in the evaluation of undertrapping.

Image 3: Image solid-printed on a region of 10 cm by 10 cm at (R,G,B)=(0,255,255) with the RGB mode of PhotoShop 7.0.

After the recording of the image, the recording medium was dried for 24 hours under an environment of 23° C. and 50% RH, and a mottled pattern on the image 3 was visually evaluated according to the following criteria.

AA: No mottled pattern according to the uneven profile was observed

A: A mottled pattern according to the uneven profile was slightly observed at several points B: A mottled pattern according to the uneven profile was slightly observed at many points C: A mottled pattern according to the uneven profile was clearly observed at many points

TABLE 2

| | Ra (μm) | Rsk | RSm (mm) | Undertrapping | Scratch | Mottled pattern |
|---|---|---|---|---|---|---|
| Example 1 | 1.4 | −0.1 | 0.50 | A | A | AA |
| Example 2 | 1.4 | −0.1 | 0.50 | A | A | AA |
| Example 3 | 1.4 | −0.1 | 0.50 | A | A | AA |
| Example 4 | 1.4 | −0.1 | 0.65 | A | A | AA |
| Example 5 | 1.4 | −0.1 | 0.66 | A | A | A |
| Example 6 | 1.1 | −0.1 | 0.50 | A | B | AA |
| Example 7 | 1.1 | −0.1 | 0.50 | B | A | AA |
| Example 8 | 1.1 | −0.1 | 0.50 | B | A | AA |
| Example 9 | 2.5 | −0.1 | 0.50 | A | A | A |
| Example 10 | 1.4 | 0.1 | 0.50 | A | A | A |
| Example 11 | 2.5 | 0.1 | 0.66 | A | A | B |
| Example 12 | 2.0 | −0.1 | 0.50 | A | A | AA |
| Comparative Example 1 | 1.0 | −0.1 | 0.50 | B | C | AA |
| Comparative Example 2 | 1.0 | −0.1 | 0.50 | C | B | AA |
| Comparative Example 3 | 2.6 | −0.1 | 0.50 | A | A | C |
| Comparative Example 4 | 1.4 | 0.2 | 0.50 | A | A | C |
| Comparative Example 5 | 1.4 | 0.2 | 0.50 | A | A | C |

From Table 2, it is understood that in each of the recording media of Examples 1 to 12, the rank C is found in none of the evaluation items of the undertrapping, scratch and mottled pattern, the rank B is found in 1 or less of such items, and the other evaluation items are ranked as A or higher, and so these recording media are good recording media.

On the other hand, the recording media of Comparative Example 1 and 2 have a Ra smaller than 1.1 μm, and so their evaluations as to both undertrapping and scratch were ranked as B or lower. The recording medium of Comparative Example 3 has a Ra greater than 2.5 μm, and so its evaluation as to the mottled pattern was ranked as C. The recording media of Comparative Example 4 and 5 have a Rsk greater than 0.1, and so their evaluation as to the mottled pattern was ranked as C.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-129272, filed Jun. 4, 2010, which is hereby incorporated by reference herein in its entirety.

What is claimed is:

1. A recording medium comprising:

a substrate; and an ink receiving layer provided on the substrate, wherein an arithmetic average roughness Ra of an outermost surface of the recording medium as prescribed by JIS B 0601:2001 is 1.1 μm or more and 2.5 μm or less, and wherein a skewness Rsk of a roughness curve of the outermost surface of the recording medium as prescribed by JIS B 0601:2001 is 0.1 or less.

2. The recording medium according to claim 1, wherein an average length RSm of a roughness curve element of the outermost surface of the recording medium as prescribed by JIS B 0601:2001 is 0.65 mm or less.

3. The recording medium according to claim 1, wherein the substrate is a resin-coated substrate obtained by coating a base material with a resin.

4. The recording medium according to claim 1, wherein the arithmetic average roughness Ra of the outermost surface of the recording medium as prescribed by JIS B 0601:2001 is 1.3 μm or more and 2.0 μm or less.

5. The recording medium according to claim 1, wherein the skewness Rsk of the roughness curve of the outermost surface of the recording medium as prescribed by JIS B 0601:2001 is 0.0 or less.

6. The recording medium according to claim 1, wherein a surface of the substrate is embossed.

7. The recording medium according to claim 6, wherein the surface of the substrate is embossed by an embossing calender treatment.

8. The recording medium according to claim 6, wherein the surface of the substrate is embossed by a roll engraved with a pattern.

9. The recording medium according to claim 5, wherein Rsk is greater than or equal to −1.5.

10. The recording medium according to claim 2, wherein RSm is greater than or equal to 0.10 and smaller than or equal to 0.60 mm.

* * * * *